US007019240B2

(12) United States Patent
Eberts et al.

(10) Patent No.: US 7,019,240 B2
(45) Date of Patent: Mar. 28, 2006

(54) ELECTRICAL SWITCHING APPARATUS INTERFACE ASSEMBLY AND OPERATING HANDLE ATTACHMENT THEREFOR

(75) Inventors: William G. Eberts, Coraopolis, PA (US); Richard P. Malingowski, Finleyville, PA (US); Roger W. Helms, Beaver Falls, PA (US); Mark A. Janusek, Pittsburgh, PA (US); Keith E. Thomas, Burgettstown, PA (US); David C. Turner, Imperial, PA (US); Ralph M. Ennis, Imperial, PA (US)

(73) Assignee: Eaton Corporation, Cleveland, OH (US)

( * ) Notice: Subject to any disclaimer, the term of this patent is extended or adjusted under 35 U.S.C. 154(b) by 151 days.

(21) Appl. No.: 10/764,940

(22) Filed: Jan. 26, 2004

(65) Prior Publication Data

US 2005/0162243 A1 Jul. 28, 2005

(51) Int. Cl.
*H01H 3/20* (2006.01)

(52) U.S. Cl. ..... 200/331; 200/334

(58) Field of Classification Search ..... 200/330–334, 200/329, 338

See application file for complete search history.

(56) References Cited

U.S. PATENT DOCUMENTS 2,723,329 A 11/1955 Baird
3,142,744 A * 7/1964 Keck ..... 200/331
3,229,056 A 1/1966 Turnbull
3,358,094 A 12/1967 Metz
3,496,320 A * 2/1970 Wasileski ..... 200/331
3,821,532 A 6/1974 Isaac, Jr. et al.
4,115,669 A 9/1978 Cali
4,615,553 A 10/1986 Hultine
4,626,638 A 12/1986 Samples et al.
5,193,666 A 3/1993 Markowski et al.
5,422,453 A * 6/1995 Smith et al. ..... 200/329
5,838,219 A 11/1998 Du et al.
5,911,316 A * 6/1999 Chu ..... 200/331
6,538,539 B1 * 3/2003 Lu ..... 335/6
6,706,984 B1 * 3/2004 Turner ..... 200/331
6,710,274 B1 * 3/2004 Whetzel et al. ..... 200/330

* cited by examiner

*Primary Examiner*—Michael Friedhofer
*Assistant Examiner*—Lisa Klaus
(74) *Attorney, Agent, or Firm*—Martin J. Moran

(57) ABSTRACT

An electrical switching apparatus interface assembly provides remote actuation of the operating handle of a circuit breaker. The interface assembly includes the circuit breaker, a second switching apparatus, such as an actuating handle disposed in a remote location from the circuit breaker, a connector and an operating handle attachment including a handle-engaging segment for securely engaging the circuit breaker operating handle and an interfacing segment for receiving the connector. The actuating handle is operable between ON and OFF positions corresponding to ON and OFF positions, respectively, of the circuit breaker operating handle. The connector interfaces or links the circuit breaker to the actuating handle. In this manner, when the actuating handle is moved from the ON or OFF position, the connector moves the circuit breaker operating handle in a likewise manner.

20 Claims, 7 Drawing Sheets

ELECTRICAL SWITCHING APPARATUS INTERFACE ASSEMBLY AND OPERATING HANDLE ATTACHMENT THEREFOR

BACKGROUND OF THE INVENTION

1. Field of the Invention

The present invention relates generally to electrical switching apparatus and, more particularly, to an electrical switching apparatus including an operating handle and an interface assembly for activating the operating handle from a remote location. The invention also relates to operating handle attachments for electrical switching apparatus interface assemblies.

2. Background Information

Electrical switching apparatus include, for example, circuit switching devices and circuit interrupters, such as circuit breakers, contactors, motor starters, motor controllers and other load controllers.

Circuit breakers are generally old and well known in the art. An example of a circuit breaker is disclosed in U.S. Pat. No. 5,341,191. Circuit breakers are used to protect electrical circuitry from damage due to an overcurrent condition, such as an overload condition or a relatively high level short circuit or fault condition. Molded case circuit breakers, for example, include at least one pair of separable contacts which are operated either manually by way of a handle disposed on the outside of the case or automatically by way of an internal trip unit in response to an overcurrent condition.

Circuit breakers typically have two or three possible operating handle positions, corresponding to the status of the separable contacts. For example, these positions may include an ON position, in which the separable contacts are closed, an OFF position in which the contacts are open, and a tripped position in which the contacts are tripped open. Typically, the handle position corresponding to the tripped position of the contacts is in between the ON and OFF positions.

In certain applications, it is often desired or required to actuate the operating handle of the circuit breaker from a remote location. For example, circuit breakers are often mounted within the interior of a metal cabinet, such as a switchboard or panel board as part of an industrial power distribution system. See, e.g., U.S. Pat. No. 4,945,450. In motor control centers, the circuit breaker is typically contained within a cabinet, which is locked, in order to prevent access when the circuit breaker is ON and the electrical equipment within the cabinet is energized. When a circuit breaker is mounted in a remote location, for example, within the interior of a switchboard, a locked electrical cabinet or any other remote location, an externally accessible switching apparatus, such as an actuating handle, is employed to interface with the circuit breaker and actuate the breaker operating handle.

A relatively simple way to move the breaker handle from such remote locations is through use of a mechanical interface or linking assembly connecting the circuit breaker operating handle to the externally accessible actuating handle. In this manner, the circuit breaker can be actuated, for example, without having to open the cabinet. In such interfacing assemblies, effective operation relies heavily upon the secure engagement of the circuit breaker operating handle and a dependable linkage between the operating handle and the external actuating handle. For example, a linkage of insufficient strength or rigidity may not be capable of overcoming the resistive forces associated with moving the circuit breaker operating handle. Inadvertent separation of the circuit breaker operating handle from the interfacing linkage would require disassembly of the electrical cabinet to access the breaker and reattach the connection.

Interfacing assemblies employ a variety of circuit breaker operating handle extensions and actuating mechanisms having a wide array of operating handle engaging mechanisms. However, construction of the assemblies is typically complex, often comprising numerous, separate parts and frequently requiring modification to the circuit breaker operating handle and/or housing.

U.S. Pat. No. 3,142,744 discloses a switch operating attachment primarily for use by children too small to reach normally placed light switches, such as wall-mounted light switches. The attachment includes a mounting head with a rectangular counter bore for receiving the end of the light switch handle. A U-shaped spring is engaged endwise in the counter bore close to the bottom of the counter bore with the spring legs extending along the counter bore walls. The spring legs serve as spring jaws for gripping the upper and lower surfaces of the switch handle. The jaws are formed with longitudinally spaced gripping teeth or corrugations so that the teeth bite into and hold the switch handle secure within the head. The attachment further includes an elongated handle, which at one end, connects to a slot in the mounting head and at the other end extends far enough downwardly from the light switch handle to be within the reach of small children.

U.S. Pat. No. 4,626,638 discloses a mechanical operating system for operating a molded case circuit breaker from a remote position. The system is comprised of numerous complex components, including a master operating assembly and a slave operator for manipulating the circuit breaker handle. The master operating assembly is fixed at a location away from the circuit breaker and includes a handle connected to a flexible cable. The flexible cable is connected to a slave operator attached to the housing of the circuit breaker and includes an opening for encapturing the circuit breaker handle. Moving the handle of the master operating assembly displaces the slave operator and the circuit breaker handle encaptured therein.

U.S. Pat. No. 5,193,666 discloses a handle extender for a molded case circuit breaker including a remote actuator mechanism. The actuator cable is arranged in an endless loop between the actuator handle and the circuit breaker operating handle. Moving the actuator handle moves the circuit breaker operating handle. The remote actuator mechanism has numerous components including the actuator cable which includes an outer sheath and an inner flexible wire connected to the circuit breaker operating handle by a U-shaped plate. A fastener, which passes through the U-shaped plate and the operating handle, secures the flexible wire to the operating handle.

There is a need, therefore, for a simplified electrical switching apparatus interface assembly and operating handle attachment that effectively secures the operating handle for actuation from a remote location, without requiring modification to the electrical switching apparatus handle or housing.

Accordingly, there is room for improvement in electrical switching apparatus interface assemblies and in interface assemblies employing operating handle attachments.

SUMMARY OF THE INVENTION

These needs and others are satisfied by the present invention, which provides an interface assembly with an attachment for the operating handle of an electrical switching apparatus. The assembly includes the operating handle attachment and a connector linking or interfacing the operating handle to a remotely disposed switching apparatus, such as an actuating handle.

As one aspect of the invention, an operating handle attachment for use with an electrical switching apparatus interface assembly includes an operating handle, an actuator disposed remote from the operating handle, and a connector therebetween. The operating handle attachment comprises: a handle-engaging segment structured to securely engage the operating handle; and an interfacing segment structured to receive the connector, in order to link the operating handle to the actuator.

The handle-engaging segment may include a member adapted to slide over the operating handle and the interfacing segment may include at least one tab disposed on the member and having an opening for receiving the connector.

Another aspect of the invention, an electrical switching apparatus interface assembly comprises: a first electrical switching apparatus including a housing having an opening and an operating handle protruding from the opening; a second switching apparatus disposed remote from the first electrical switching apparatus, in order to permit remote actuation of the operating handle of the first electrical switching apparatus; a connector including a first portion linking the second switching apparatus and a second portion; and an operating handle attachment comprising: a handle-engaging segment securely engaging the operating handle of the first electrical switching apparatus; and an interfacing segment receiving the second portion of the connector, in order to link the operating handle of the first electrical switching apparatus to the second switching apparatus.

As another aspect of the invention, a power distribution system comprises: a switchgear cabinet including an interior and an external panel; a first electrical switching apparatus mounted within the interior of the switchgear cabinet, the first electrical switching apparatus including a housing having an opening and an operating handle protruding from the opening; a second switching apparatus disposed on the external panel of the switchgear cabinet, the second switching apparatus being remote from the first electrical switching apparatus, in order to permit actuation of the operating handle of the first electrical switching apparatus therefrom; a connector including a first portion linking the second switching apparatus and a second portion; and an operating handle attachment comprising: a handle-engaging segment securely engaging the operating handle of the first electrical switching apparatus; and an interfacing segment receiving the second portion of the connector, in order to link the operating handle of the first electrical switching apparatus to the second switching apparatus.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

For purposes of illustration, the invention will be described as applied to a circuit breaker, although it will become apparent that it could also be applied to other types of electrical switching apparatus (e.g., without limitation, circuit switching devices and other circuit interrupters such as contactors, motor starters, motor controllers and other load controllers).

As employed herein, the term "switchgear cabinet" refers to the cabinet of a power distribution system such as, for example, a panel board or load center, which is structured to secure electrical switching apparatus, expressly including, but not limited to, circuit breakers.

As employed herein, the term "fastener" refers to any suitable fastening, connecting or tightening mechanism expressly including, but not limited to, screws, bolts and the combination of bolts and nuts.

Figure 1:
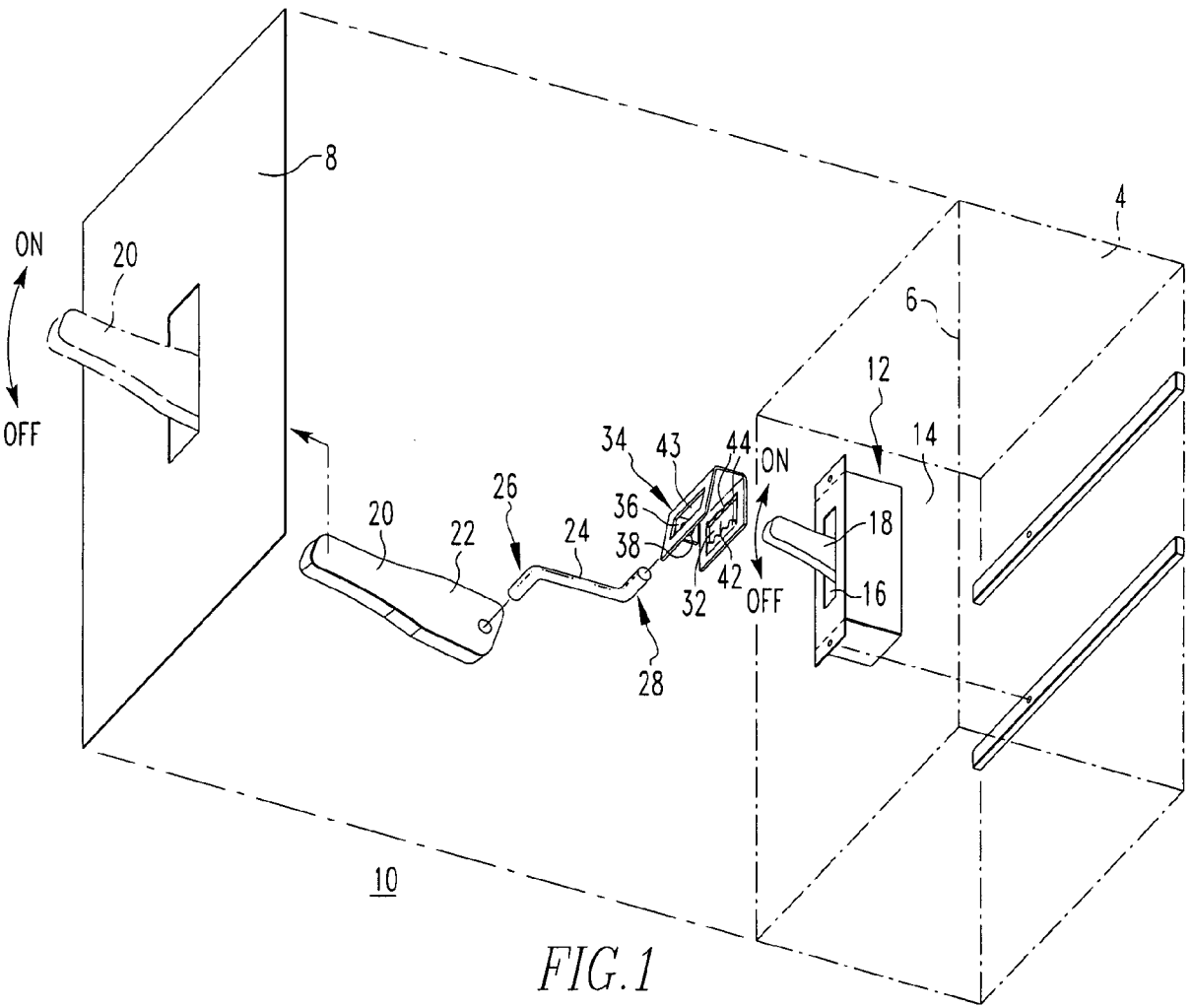
FIG. 1 is an exploded, isometric view of a circuit breaker interface assembly in accordance with the present invention.

FIG. 1 illustrates a power distribution system 2 employing an electrical switching apparatus interface assembly 10 to remotely actuate a circuit breaker 12. As shown, the basic components of the power distribution system 2 include a switchgear cabinet 4 having an interior 6 and an external panel 8. A first electrical switching apparatus, such as the exemplary circuit breaker 12, is mounted within the interior 6 of the switchgear cabinet 4. The exemplary circuit breaker 12 includes a housing 14 having an opening 16 and an operating handle 18 protruding from the opening 16. A second switching apparatus, such as the exemplary actuating handle 20, is disposed on the external panel 8 of the switchgear cabinet 4, remote from the circuit breaker 12, in order to permit actuation of the operating handle 18 therefrom. A connector 24 including a first portion 26 links or interfaces with a connector tab 22 on the backside of the actuating handle 20. The connector 24 also includes a second portion 28 connected to an operating handle attachment 30. The exemplary connector 24 is a steel rod, however, it will be appreciated that any suitable alternative connector (not shown), made from any suitable material and structured to be rigid or flexible (not shown), may be employed.

Continuing to refer to FIG. 1, the operating handle attachment 30 includes a handle-engaging segment 32, structured to securely engage the operating handle 18 of the circuit breaker 12, and an interfacing segment 34, structured to receive the second portion 28 of the connector 24, in order to link or interface the circuit breaker operating handle 18 with the remotely located actuating handle 20.

The circuit breaker operating handle 18 is operable between a first position and a second position corresponding to "on" and "off" circuit breaker operating modes in which the circuit breaker is, respectively, capable of energizing or not energizing the power distribution system 2. The circuit breaker operating handle 18 is securely engaged within the handle-engaging segment 32 of the operating handle attachment 30 and is linked or connected to the exemplary actuating handle 20 by the connector 24 which has first and second positions corresponding to the first and second, "on" and "off" positions, respectively, of the operating handle 18. This permits remote actuation of the circuit breaker 12 located within the interior 6 of the switchgear cabinet 4 from the remote location on the external panel 8 of the switchgear cabinet 4.

Figure 2:
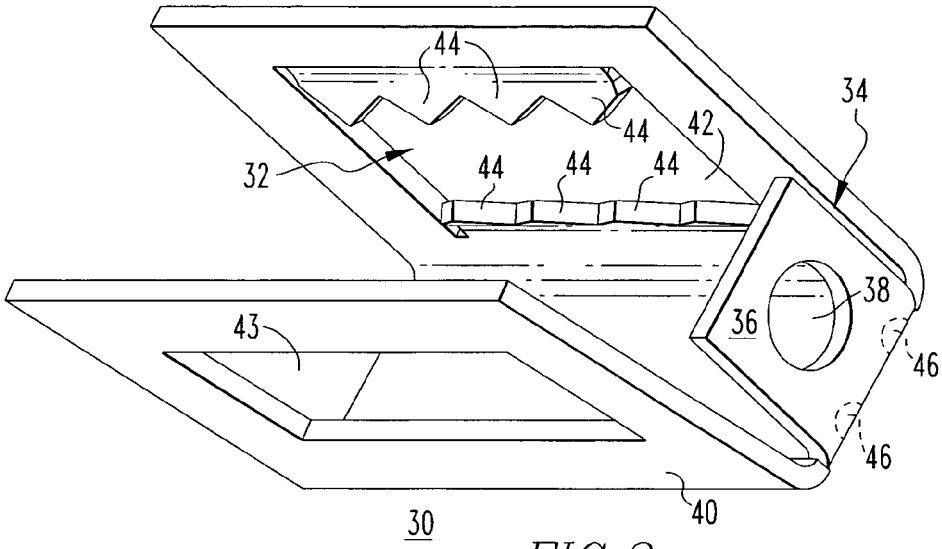
FIG. 2 is an isometric view of the operating handle attachment of FIG. 1.

FIGS. 3–7 show example alternative embodiments of the operating handle attachment 30 of FIGS. 1 and 2. Each of these operating handle attachments is structured for securely engaging the operating handle 18 of the circuit breaker 12, in order to provide a secure interfacing attachment location for the connector 24 (FIG. 1) to facilitate remote actuation of the circuit breaker 12 using, for example, the exemplary actuating handle 20 (FIG. 1).

Figure 8:
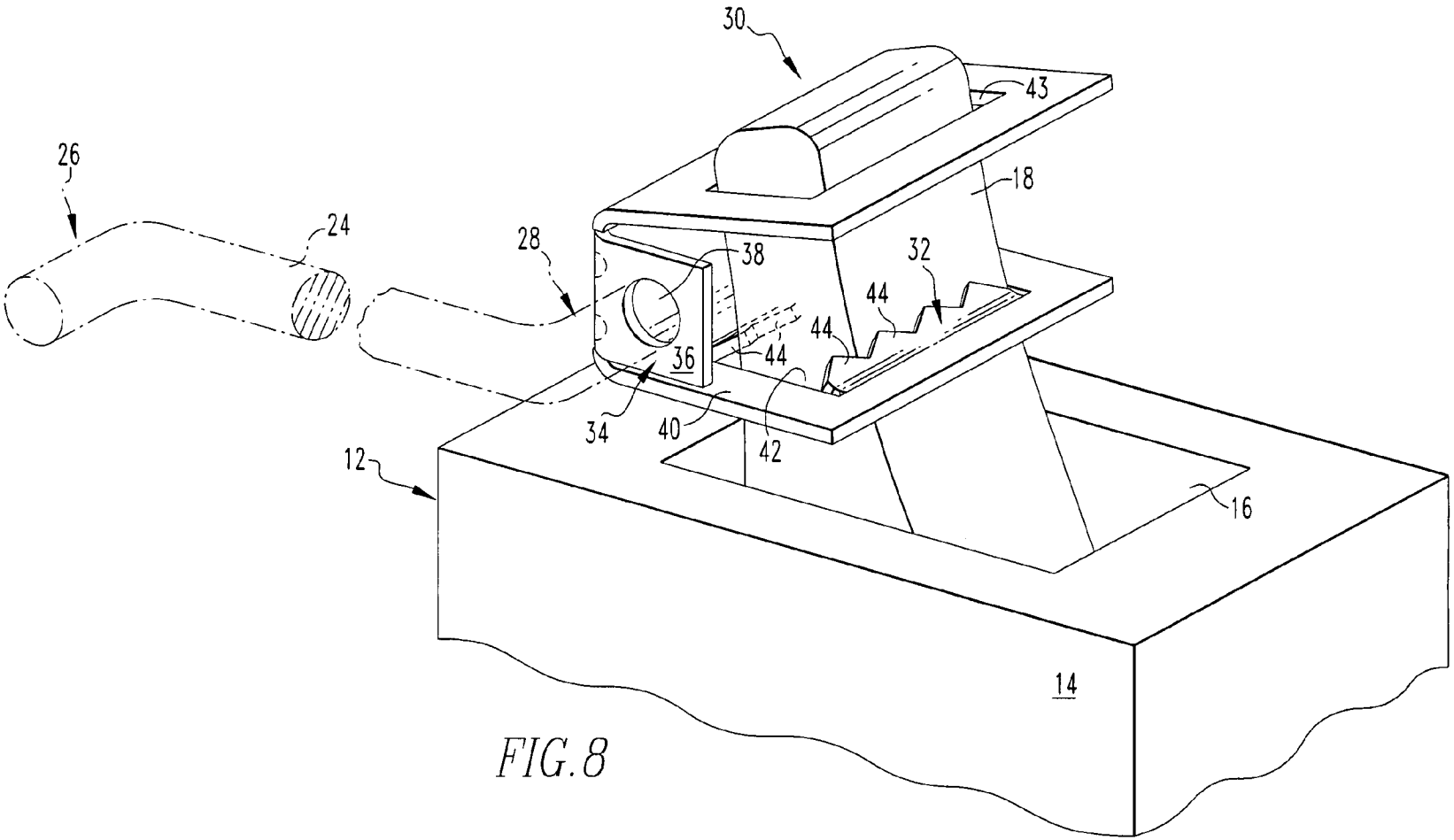
FIG. 8 is an isometric view of the operating handle attachment of FIG. 2 engaging the operating handle of a single-pole circuit breaker in accordance with an embodiment of the invention, with the connector shown in phantom-line drawing.

As best shown in FIG. 2, the operating handle attachment 30 is a stamped metal member 40 formed to slide over the top of the circuit breaker handle 18 (FIG. 1). The stamped metal member 40 includes the handle-engaging segment 32 consisting of a pair of opposing handle-receiving apertures 42, 43. At least one of the handle-receiving apertures 42, 43 includes at least one projection, such as the exemplary plural serrations 44 (one of the opposing handle-receiving apertures 42 is shown with a plurality of serrations 44 (e.g., or teeth) in FIG. 2. The exemplary interfacing segment 34 includes at least one tab 36 disposed on the stamped metallic member 40. The tab 36 has an opening 38 for receiving the connector 24 (FIG. 1) therein. As shown in FIG. 8, the serrations 44 engage the operating handle 18 when it is inserted therethrough, thereby securely engaging such operating handle. The operating handle attachment 30 may optionally include a pair of strengthening ribs 46 to increase the rigidity of the tab 36. The exemplary stamped metallic member 40 is formed from steel. However, it will be appreciated that the operating handle attachment 30 could be made from any suitable alternative material.

Figure 3:
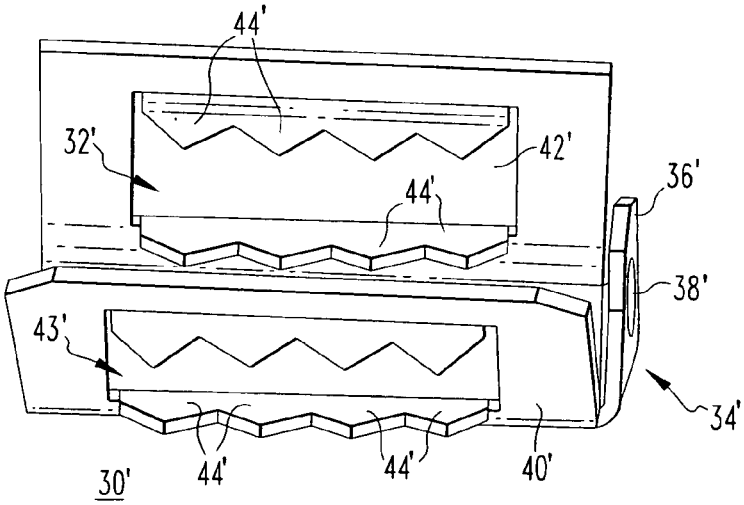
FIGS. 3–7 are isometric views of operating handle attachments for interface assemblies in accordance with other embodiments of the invention.

FIG. 3 shows another operating handle attachment 30'. The operating handle attachment 30' is nearly identical to the operating handle attachment 30 of FIG. 2, including a stamped metallic member 40' having a handle-engaging segment 32' including opposing handle-receiving apertures 42', 43' and an interfacing segment 34' including a tab 36' with an opening 38'. However, as shown, both of the handle-receiving apertures 42', 43' include a plurality of serrations 44' (e.g., teeth), structured to securely engage the operating handle 18 (FIG. 1).

Figure 4:
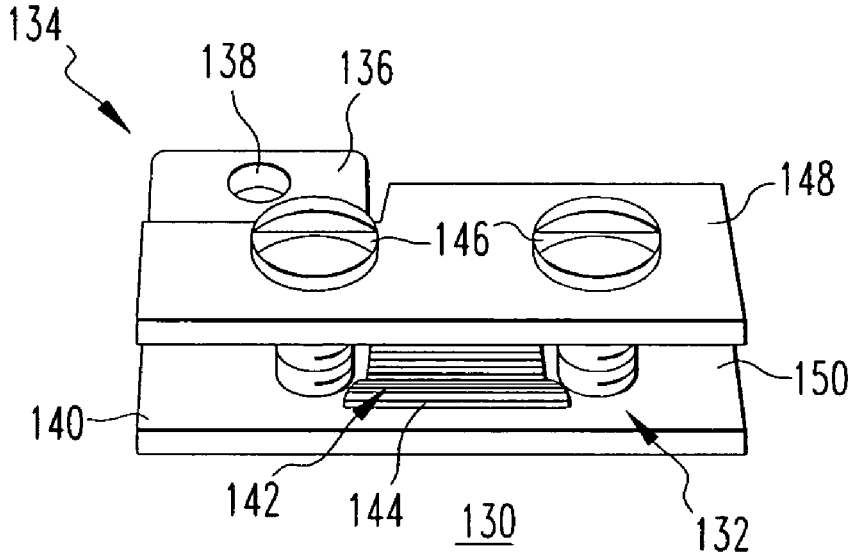

As shown in FIG. 4, another operating handle attachment 130 includes a handle-engagement segment 132 consisting of a clamping segment 142 having opposing sides 148, 150 and two spaced-apart fasteners, such as the exemplary screws 146. The interfacing segment 134 consists of a tab 136 on opposing side 150, which includes an opening 138 for receiving the connector 24 (FIG. 1) similar to the manner in which the operating handle attachment 30 of FIG. 1 receives such connector. The exemplary operating handle attachment 130 is a metallic member 140 including at least one projection, such as the plurality of serrations 144, shown, on at least one of the opposing sides 148, 150 (the serrations 144 are shown on opposing side 150 in FIG. 4).

Figure 5:
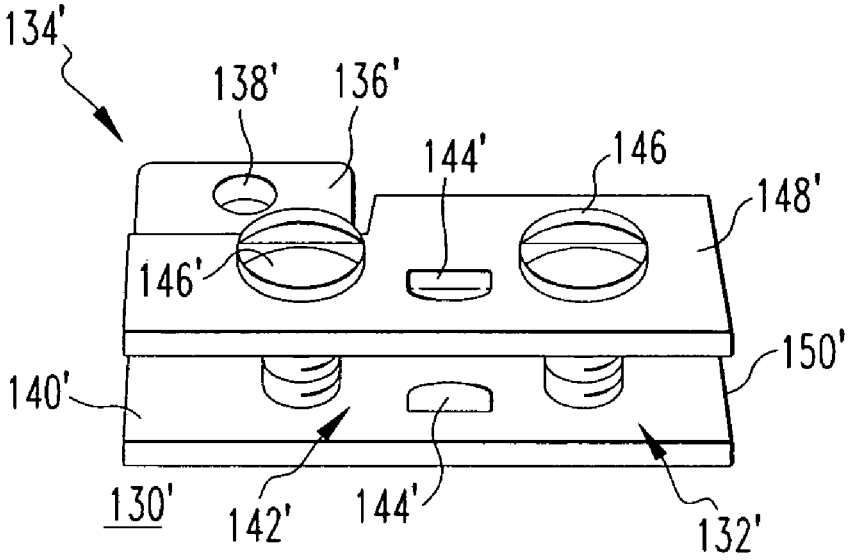

FIG. 5 illustrates an operating handle attachment 130' substantially similar to the operating handle attachment 130 of FIG. 4. The exemplary metallic member 140' includes a handle-engaging segment 132' consisting of a clamping segment 142' with opposing sides 148', 150'. The interfacing segment 134' consists of a tab 136' having an opening 138' for receiving the connector 24 (FIG. 1). Two locking mechanisms or fasteners, such as the exemplary screws 146, extend between the opposing sides 148', 150', in order to compress the opposing sides 148', 150' against the circuit breaker operating handle 18 (FIG. 1) when the top of such operating handle is inserted into the clamping segment 142' between the exemplary screws 146 and such screws are tightened. However, in this embodiment, the at least one projection includes a single projection 144' on each of the opposing sides 148', 150', structured to further secure the circuit breaker operating handle 18 (FIG. 1) when the exemplary screws 146 are tightened.

Figure 6:
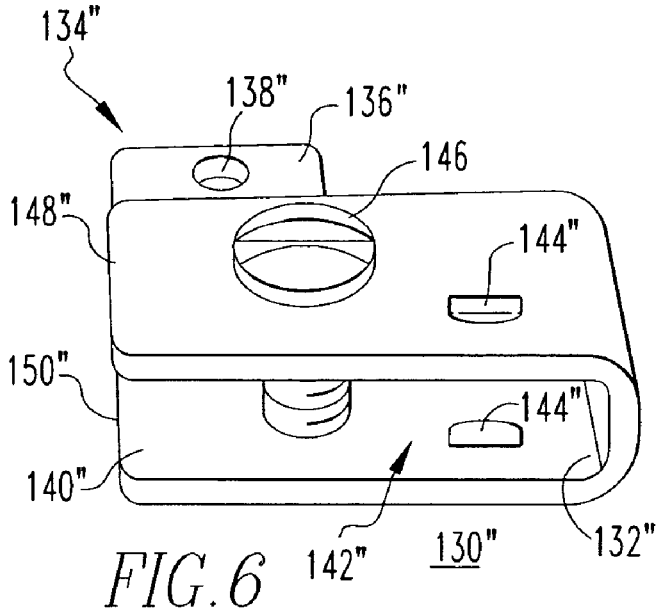

FIG. 6 shows another operating handle attachment 130" consisting of a metallic member 140" formed to include a handle-engaging segment 132" having a clamping segment 142" with opposing sides 148", 150" and a fastener, such as the exemplary screw 146, in order to compress the opposing sides 148", 150" together when tightened. The interfacing segment 134" consists of a tab 136", which is part of opposing side 150" and which includes an opening 138" to receive the connector 24 (FIG. 1). The exemplary embodiment of the operating handle attachment 130" includes a single projection 144" on each of the opposing sides 148", 150".

The operating handle attachments 130, 130', 130" of FIGS. 4–6 may be machined or formed from a material, such as, for example, metal. However, it will be appreciated that such operating handle attachments may be made from processes other than machining, such as, for example, forming or casting. Additionally, the attachments may employ a variety of suitable alternative shapes and sizes (not shown), and may be made from a wide variety of suitable materials (not shown).

Figure 7:
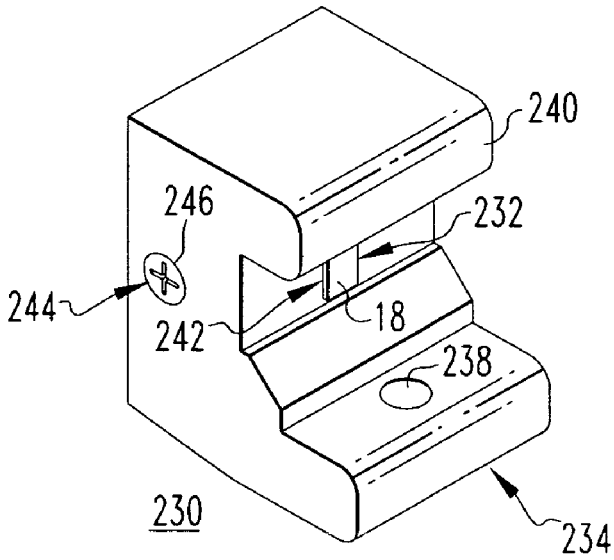

For example, FIG. 7 shows an operating handle attachment 230 in which the handle-engaging segment 232 includes a molded member 240, molded from a material such as, for example, plastic. The molded member 240 includes a handle-receiving aperture 242 for receiving the end of the circuit breaker operating handle 18 (FIG. 1). An opening 244 in the molded member 240 receives a threaded fastener, such as the exemplary set screw 246, in order to engage the operating handle 18 when the set screw 246 is tightened. The interfacing segment 234 consists of an opening 238 formed in the molded member 240, as shown, to receive the connector 24 (FIG. 1).

FIG. 8 illustrates the operating handle attachment 30 of FIGS. 1 and 2, as employed on the operating handle 18 of the single-pole circuit breaker 12. In operation, the exemplary stamped metallic member 40 slides over the top of the circuit breaker operating handle 18, in order that such handle fits through the opposing handle-receiving apertures 42, 43 and is securely engaged by the serrations 44. The second portion 28 of the exemplary connector 24 (shown in phantom-line drawing) is then inserted through the opening 38 in the tab 36 of the interfacing segment 34. The first portion 26 of the connector 24 is then interfaced or linked with another switching apparatus, such as the exemplary actuating handle 20 (FIG. 1) to permit remote operation of the circuit breaker operating handle 18.

Figure 9:
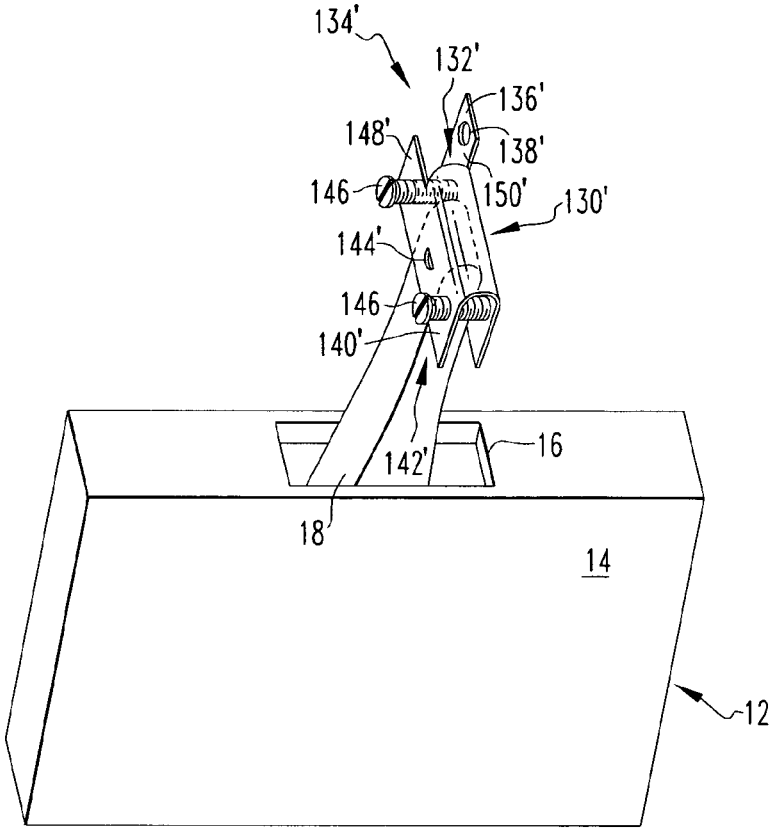
FIG. 9 is an isometric view of the operating handle attachment of FIG. 5 engaging the operating handle of a single-pole circuit breaker in accordance with an embodiment of the invention, with the operating handle shown in hidden-line drawing.

FIG. 9 shows the operating handle attachment 130' of FIG. 5 as employed on the operating handle 18 of the single-pole circuit breaker 12. In this embodiment, the operating handle 18 fits within the clamping segment 142' of the handle-engaging segment 132', as shown. The exemplary screws 146, on either side of the operating handle 18, are then tightened to compress the opposing sides 148', 150', against the operating handle 18 to secure it therein. The projection 144' on each of the opposing sides 148', 150' operates to further secure the operating handle 18.

Figure 10:
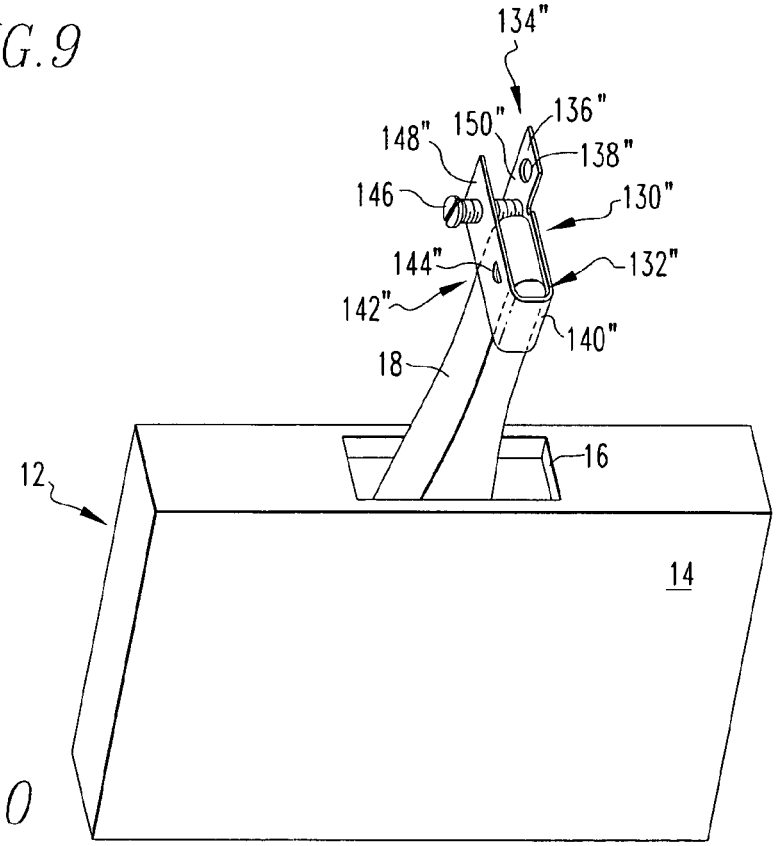
FIG. 10 is an isometric view of the operating handle attachment of FIG. 6 engaging the operating handle of a single-pole circuit breaker in accordance with another embodiment of the invention, with the operating handle shown in hidden-line drawing.

As shown in FIG. 10, the operating handle attachment 130" of FIG. 6 is employed in much the same manner as described above with respect to FIG. 9. As shown, the metallic member 140" forms a generally U-shaped handle-engaging segment 132" including a clamping segment 142" with opposing sides 148", 150" structured to receive the operating handle 18 therebetween. The single screw 146, adjacent the operating handle 18, compresses the opposing sides 148", 150" against the operating handle 18 when tightened. The single projection 144" on each of the opposing sides 148", 150" functions to further secure the operating handle 18. In this manner, the connector 24 (FIG. 1) may be inserted through the opening 138" in the tab 136" on opposing side 150" to facilitate actuation of the operating handle 18 from a remote location, for example, the external panel 8 (FIGS. 1 and 11) of the switchgear cabinet 4 (FIGS. 1 and 11).

It will be appreciated that the operating handle attachments of FIGS. 8–10 could be disposed in any number of suitable alternative orientations (not shown) on the circuit breaker operating handle 18. It will also be appreciated that any suitable variation (not shown) or count (not shown) of operating handle attachment components, for example, tab 36, opening 38 or fastener 146, may be employed.

Figure 11:
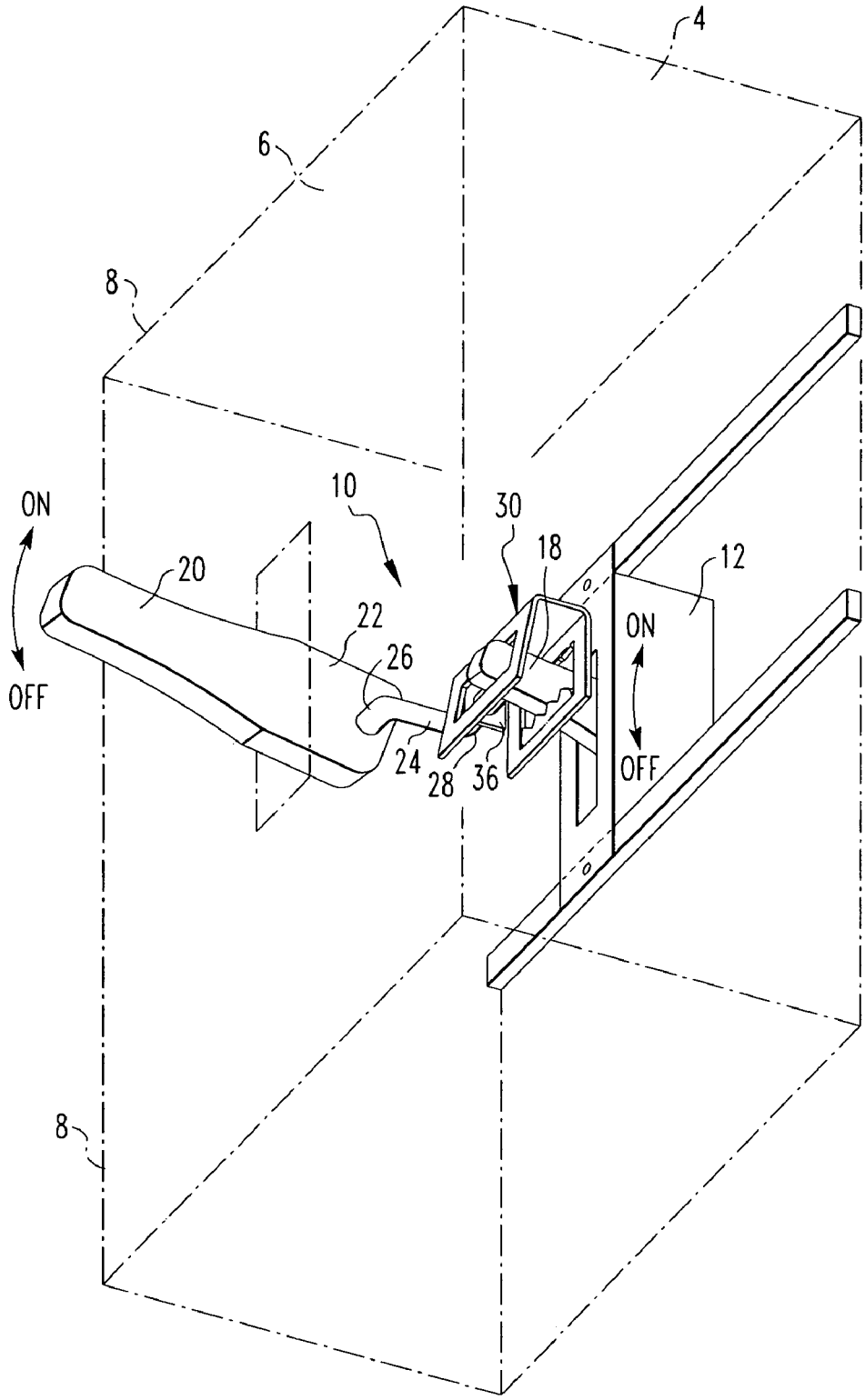
FIG. 11 is an isometric view of the circuit breaker interface assembly of FIG. 1 with a portion of the switchgear cabinet cut-away to show internal structures.

FIG. 11 illustrates the exemplary assembled power distribution system 2 and electrical switching apparatus interface assembly 10. As shown, the circuit breaker 12 is disposed within the interior 6 of the switchgear cabinet 4. The operating handle attachment 30 is securely engaging the circuit breaker operating handle 18. The tab 36 receives the second portion 28 of the connector 24. The connector tab 22 on the underside of the exemplary actuating handle 20 extends downwardly through the external panel 8 of the switchgear cabinet 40, to receive the first portion 26 of connector 24, as shown. In this manner, the circuit breaker 12 located within the interior 6 of the switchgear cabinet 4 may be actuated from the external, remote location on the external panel 8. As shown, the circuit breaker operating handle 18 has first and second "on" and "off" positions. The exemplary actuating handle 20 is likewise operable between two positions corresponding to the "on" and "off" positions of the circuit breaker 12. Accordingly, for example, when the actuating handle 20 is pivoted from the "off" position to the "on" position, the exemplary steel rod connector 24 interfaces or transmits such movement to the operating handle attachment 30, thereby moving the circuit breaker operating handle 18 to the "on" position, in order to energize the power distribution system 2.

It will be appreciated that any count of suitable connectors (not shown) other than the exemplary steel rod connector 24 and having a wide array of different orientations (not shown), may alternatively be employed. For example, a flexible cable connector (not shown) could alternatively be used to interface or link the electrical switching apparatus. It will also be appreciated that the interface assembly 10 may be employed with a wide variety of electrical switching apparatus (not shown), other than the exemplary single-pole circuit breaker 12 (e.g., without limitation, multi-pole circuit breakers).

Accordingly, the present invention provides a simplified interface as contrasted with the known prior art by eliminating unnecessary, cumbersome parts and replacing complex designs with one that can be readily employed with a variety of switches without requiring modification to the switch handle or electrical switching apparatus housing.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An operating handle attachment for use with an electrical switching apparatus interface assembly including an operating handle, an actuator disposed remote from said operating handle, and a connector therebetween, said operating handle attachment comprising:

a handle-engaging segment structured to securely engage said operating handle; and an interfacing segment structured to receive said connector, in order to link said operating handle to said actuator, said interfacing segment being integral with said handle-engaging segment in order that said operating handle attachment is a single-piece.

2. The operating handle attachment of claim 1 wherein said handle-engaging segment includes a member adapted to slide over said operating handle; and wherein said interfacing segment includes at least one tab disposed on said member, said at least one tab having an opening for receiving said connector.

3. The operating handle attachment of claim 2 wherein said member includes at least one handle-receiving aperture; and wherein at least one of said at least one handle-receiving aperture includes at least one projection for further securing said operating handle.

4. The operating handle attachment of claim 2 wherein said member includes a clamping segment having opposing sides for receiving said operating handle therebetween; and wherein said handle-engaging segment further includes at least one tightening mechanism structured to compress said opposing sides against said operating handle when said at least one tightening mechanism is tightened.

5. The operating handle attachment of claim 4 wherein said at least one tightening mechanism includes a pair of spaced apart fasteners extending between said opposing sides on either side of said operating handle, in order to compress said opposing sides against said operating handle when said fasteners are tightened.

6. The operating handle attachment of claim 4 wherein said at least one locking mechanism includes a single fastener extending between said opposing sides of said clamping segment and adjacent said operating handle, in order to compress said opposing sides against said operating handle when said single fastener is tightened.

7. The operating handle attachment of claim 4 wherein at least one of said opposing sides further includes at least one projection structured to further secure said operating handle.

8. The operating handle attachment of claim 7 wherein said at least one projection includes a plurality of serrations.

9. The operating handle attachment of claim 2 wherein said member of said handle-engaging segment is a metallic member.

10. The operating handle attachment of claim 1 wherein said handle-engaging segment includes a molded member with a handle-receiving aperture for receiving said operating handle; and wherein said interfacing segment includes an opening in said molded member for receiving said connector.

11. The operating handle attachment of claim 10 wherein said molded member includes an opening and a threaded fastener inserted through said opening in order to engage said operating handle when said threaded fastener is tightened, in order to further secure said operating handle.

12. The operating handle attachment of claim 11 wherein said threaded fastener is a set-screw.

13. An operating handle attachment for use with an electrical switching apparatus interface assembly including an operating handle, an actuator disposed remote from said operating handle, and a connector therebetween, said operating handle attachment comprising:

a handle-engaging segment structured to securely engage said operating handle, said handle-engaging segment including a member adapted to slide over said operating handle, said member including at least one handle-receiving aperture, said at least one handle-receiving aperture including at least one projection for further securing said operating handle; and an interfacing segment structured to receive said connector, in order to link said operating handle to said actuator, said interfacing segment including at least one tab disposed on said member, said at least one tab having an opening for receiving said connector, wherein said at least one handle-receiving aperture is a pair of opposing apertures, and wherein said at least one projection is a plurality of serrations disposed on one of said apertures.

14. The operating handle attachment of claim 13 wherein the other one of said apertures of said pair of opposing apertures includes a plurality of serrations.

15. An electrical switching apparatus interface assembly comprising:

a first electrical switching apparatus including a housing having an opening and an operating handle protruding from said opening;

a second independently pivotable switching apparatus disposed remote from said first electrical switching apparatus, in order to permit remote actuation of the operating handle of said first electrical switching apparatus;

a rigid connector including a first portion linking said second independently pivotable switching apparatus and a second portion; and an operating handle attachment comprising:

a handle-engaging segment securely engaging the operating handle of said first electrical switching apparatus; and an interfacing segment receiving the second portion of said rigid connector, in order to link the operating handle of said first electrical switching apparatus to said second independently pivotable switching apparatus.

16. The interface assembly of claim 15 wherein said first electrical switching apparatus is a circuit breaker having the operating handle operable between a first position and a second position; wherein the operating handle of said circuit breaker is securely engaged within said handle-engaging segment of said operating handle attachment; wherein said second independently pivotable switching apparatus includes an actuating handle disposed at a remote location from said circuit breaker, said actuating handle having first and second positions corresponding to the first and second positions, respectively, of said operating handle; and wherein said rigid connector links said actuating handle to the interfacing segment of said operating handle attachment, thereby permitting remote actuation of said circuit breaker from said remote location.

17. The interface assembly of claim 15 wherein the interfacing segment of said operating handle attachment includes an aperture receiving said rigid connector therein; and wherein said rigid connector is a rod having a first end coupled to said actuating handle and a second end coupled to the aperture of the interfacing segment of said operating handle attachment.

18. A power distribution system comprising:

a switchgear cabinet including an interior and an external panel;

a first electrical switching apparatus mounted within the interior of said switchgear cabinet, said first electrical switching apparatus including a housing having an opening and an operating handle protruding from said opening;

a second independently pivotable switching apparatus disposed on the external panel of said switchgear cabinet, said second independently pivotable switching apparatus being remote from said first electrical switching apparatus, in order to permit actuation of the operating handle of said first electrical switching apparatus therefrom;

a rigid connector including a first portion linking said second independently pivotable switching apparatus and a second portion; and an operating handle attachment comprising:

a handle-engaging segment securely engaging the operating handle of said first electrical switching apparatus; and an interfacing segment receiving the second portion of said rigid connector, in order to link the operating handle of said first electrical switching apparatus to said second independently pivotable switching apparatus.

19. The power distribution system of claim 18 wherein said first electrical switching apparatus is a circuit breaker having the operating handle operable between a first position and a second position; wherein the operating handle of said circuit breaker is securely engaged within said handle-engaging segment of said operating handle attachment; wherein said second independently pivotable switching apparatus includes an actuating handle having first and second positions corresponding to the first and second positions, respectively, of said operating handle, said actuating handle being disposed on the external panel of said switchgear cabinet and remote from said circuit breaker; and wherein said rigid connector links said actuating handle to the interfacing segment of said operating handle attachment, thereby permitting remote actuation of said circuit breaker within the interior of said switchgear cabinet from said remote location on said external panel of said switchgear cabinet.

20. The power distribution system of claim 19 wherein the interfacing segment of said operating handle attachment includes an aperture receiving said rigid connector therein; wherein said actuating handle includes a connector tab extending through the external panel of said switchgear cabinet into said switchgear cabinet; and wherein said rigid connector is a rod having a first end coupled to the connector tab of said actuating handle and a second end coupled to the aperture of the interfacing segment of said operating handle attachment.

* * * * *